US006232856B1

(12) United States Patent
Boucher et al.

(10) Patent No.: US 6,232,856 B1
(45) Date of Patent: May 15, 2001

(54) MAGNETIC SHUNT ASSEMBLY

(75) Inventors: George Boucher, Plainville; Marshall B. Hart, Middletown, both of CT (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/432,643

(22) Filed: Nov. 2, 1999

(51) Int. Cl.[7] ..... H01H 83/00
(52) U.S. Cl. ..... 335/16; 218/22
(58) Field of Search ..... 335/16, 147, 195; 218/22, 25, 35, 36

(56) References Cited

U.S. PATENT DOCUMENTS

| | | |
|---|---|---|
| D. 367,265 | 2/1996 | Yamagata et al. . |
| 2,340,682 | 2/1944 | Powell . |
| 2,719,203 | 9/1955 | Gelzheiser et al. . |
| 2,937,254 | 5/1960 | Ericson . |
| 3,158,717 | 11/1964 | Jencks et al. . |
| 3,162,739 | 12/1964 | Klein et al. . |
| 3,197,582 | 7/1965 | Norden . |
| 3,307,002 | 2/1967 | Cooper . |
| 3,517,356 | 6/1970 | Hanafusa . |
| 3,631,369 | 12/1971 | Menocal . |
| 3,803,455 | 4/1974 | Willard . |
| 3,883,781 | 5/1975 | Cotton . |
| 4,129,762 | 12/1978 | Bruchet . |
| 4,144,513 | 3/1979 | Shafer et al. . |
| 4,158,119 | 6/1979 | Krakik . |
| 4,165,453 | 8/1979 | Hennemann . |
| 4,166,988 | 9/1979 | Ciarcia et al. . |
| 4,220,934 | 9/1980 | Wafer et al. . |
| 4,255,732 | 3/1981 | Wafer et al. . |
| 4,259,651 | 3/1981 | Yamat . |
| 4,263,492 | 4/1981 | Maier et al. . |
| 4,276,527 | 6/1981 | Gerbert-Gaillard et al. . |
| 4,297,663 | 10/1981 | Seymour et al. . |

(List continued on next page.)

FOREIGN PATENT DOCUMENTS

| | | |
|---|---|---|
| 819 008 | 12/1974 | (BE) . |
| 12 27 978 | 11/1966 | (DE) . |
| 30 47 360 | 6/1982 | (DE) . |
| 38 02 184 | 8/1989 | (DE) . |
| 38 43 277 | 6/1990 | (DE) . |
| 44 19 240 | 1/1995 | (DE) . |
| 0 061 092 | 9/1982 | (EP) . |
| 0 064 906 | 11/1982 | (EP) . |
| 0 066 486 | 12/1982 | (EP) . |
| 0 076 719 | 4/1983 | (EP) . |
| 0 117 094 | 8/1984 | (EP) . |
| 0 140 761 | 5/1985 | (EP) . |
| 0 174 904 | 3/1986 | (EP) . |
| 0 196 241 | 10/1986 | (EP) . |
| 0 224 396 | 6/1987 | (EP) . |
| 0 235 479 | 9/1987 | (EP) . |
| 0 239 460 | 9/1987 | (EP) . |
| 0 258 090 | 3/1988 | (EP) . |
| 0 264 313 | 4/1988 | (EP) . |
| 0 264 314 | 4/1988 | (EP) . |
| 0 283 189 | 9/1988 | (EP) . |
| 0 283 358 | 9/1988 | (EP) . |
| 0 291 374 | 11/1988 | (EP) . |
| 0 295 155 | 12/1988 | (EP) . |

(List continued on next page.)

*Primary Examiner*—Lincoln Donovan
(74) *Attorney, Agent, or Firm*—Cantor Colburn LLP; Carl B. Horton

(57) ABSTRACT

A ferromagnetic structure for use in a circuit interruption mechanism, the, ferromagnetic structure has a first ferromagnetic layer having a lower surface and an upper surface, a second ferromagnetic layer having a lower surface and an upper surface, at least one ferromagnetic layer being positioned within the first and second ferromagnetic layers and having a lower surface and an upper surface, at least one recess in the lower surfaces of the ferromagnetic layers; and at least one protrusion in the upper surfaces of the ferromagnetic layers, the protrusions are received into the recesses.

8 Claims, 9 Drawing Sheets

U.S. PATENT DOCUMENTS

| | | | | |
|---|---|---|---|---|
| 4,301,342 | | 11/1981 | Castonguay et al. . | |
| 4,360,852 | | 11/1982 | Gilmore . | |
| 4,368,444 | | 1/1983 | Preuss et al. . | |
| 4,375,021 | | 2/1983 | Pardini et al. . | |
| 4,375,022 | | 2/1983 | Daussin et al. . | |
| 4,376,270 | | 3/1983 | Staffen . | |
| 4,383,146 | | 5/1983 | Bur . | |
| 4,392,036 | | 7/1983 | Troebel et al. . | |
| 4,393,283 | | 7/1983 | Masuda . | |
| 4,401,872 | | 8/1983 | Boichot-Castagne et al. . | |
| 4,409,573 | | 10/1983 | DiMarco et al. . | |
| 4,435,690 | | 3/1984 | Link et al. . | |
| 4,467,297 | | 8/1984 | Boichot-Castagne et al. . | |
| 4,468,645 | | 8/1984 | Gerbert-Gaillard et al. . | |
| 4,470,027 | * | 9/1984 | Link et al. | 335/16 |
| 4,479,143 | | 10/1984 | Wanatabe et al. . | |
| 4,488,133 | | 12/1984 | McClellan et al. . | |
| 4,492,941 | | 1/1985 | Nagel . | |
| 4,541,032 | | 9/1985 | Schwab . | |
| 4,546,224 | | 10/1985 | Mostosi . | |
| 4,550,360 | | 10/1985 | Dougherty . | |
| 4,562,419 | | 12/1985 | Preuss et al. . | |
| 4,589,052 | | 5/1986 | Dougherty . | |
| 4,595,812 | | 6/1986 | Tamaru et al. . | |
| 4,611,187 | | 9/1986 | Banfi . | |
| 4,612,430 | | 9/1986 | Sloan et al. . | |
| 4,616,198 | | 10/1986 | Pardini . | |
| 4,622,444 | | 11/1986 | Kandatsu et al. . | |
| 4,631,625 | | 12/1986 | Alexander et al. . | |
| 4,642,431 | | 2/1987 | Tedesco et al. . | |
| 4,644,438 | | 2/1987 | Puccinelli et al. . | |
| 4,649,247 | | 3/1987 | Preuss et al. . | |
| 4,658,322 | | 4/1987 | Rivera . | |
| 4,672,501 | | 6/1987 | Bilac et al. . | |
| 4,675,481 | | 6/1987 | Markowski et al. . | |
| 4,682,264 | | 7/1987 | Demeyer . | |
| 4,689,712 | | 8/1987 | Demeyer . | |
| 4,694,373 | | 9/1987 | Demeyer . | |
| 4,710,845 | | 12/1987 | Demeyer . | |
| 4,717,985 | | 1/1988 | Demeyer . | |
| 4,733,211 | | 3/1988 | Castonguay et al. . | |
| 4,733,321 | | 3/1988 | Lindeperg . | |
| 4,764,650 | | 8/1988 | Bur et al. . | |
| 4,768,007 | | 8/1988 | Mertz et al. . | |
| 4,780,786 | | 10/1988 | Weynachter et al. . | |
| 4,831,221 | | 5/1989 | Yu et al. . | |
| 4,870,531 | | 9/1989 | Danek . | |
| 4,883,931 | | 11/1989 | Batteux et al. . | |
| 4,884,047 | | 11/1989 | Baginski et al. . | |
| 4,884,164 | | 11/1989 | Dziura et al. . | |
| 4,900,882 | | 2/1990 | Bernard et al. . | |
| 4,910,485 | | 3/1990 | Bolongeat-Mobleu et al. . | |
| 4,914,541 | | 4/1990 | Tripodi et al. . | |
| 4,916,420 | | 4/1990 | Bartolo et al. . | |
| 4,916,421 | | 4/1990 | Pardini et al. . | |
| 4,926,282 | | 5/1990 | McGhie . | |
| 4,935,590 | | 6/1990 | Malkin et al. . | |
| 4,937,706 | | 6/1990 | Schueller et al. . | |
| 4,939,492 | | 7/1990 | Raso et al. . | |
| 4,943,691 | | 7/1990 | Mertz et al. . | |
| 4,943,888 | | 7/1990 | Jacob et al. . | |
| 4,950,855 | | 8/1990 | Bolonegeat-Mobleu et al. . | |
| 4,951,019 | | 8/1990 | Gula . | |
| 4,952,897 | | 8/1990 | Barnel et al. . | |
| 4,958,135 | | 9/1990 | Baginski et al. . | |
| 4,963,849 | * | 10/1990 | Kowalczyk et al. | 335/201 |
| 4,965,543 | | 10/1990 | Batteux . | |
| 4,983,788 | | 1/1991 | Pardini . | |
| 5,001,313 | | 3/1991 | Leclerq et al. . | |
| 5,004,878 | | 4/1991 | Seymour et al. . | |
| 5,029,301 | * | 7/1991 | Nebon et al. | 335/16 |
| 5,030,804 | | 7/1991 | Abri . | |
| 5,057,655 | | 10/1991 | Kersusan et al. . | |
| 5,077,627 | | 12/1991 | Fraisse . | |
| 5,083,081 | | 1/1992 | Barrault et al. . | |
| 5,095,183 | | 3/1992 | Raphard et al. . | |
| 5,103,198 | | 4/1992 | Morel et al. . | |
| 5,115,371 | | 5/1992 | Tripodi . | |
| 5,120,921 | | 6/1992 | DiMarco et al. . | |
| 5,132,865 | | 7/1992 | Mertz et al. . | |
| 5,138,121 | | 8/1992 | Streich et al. . | |
| 5,140,115 | | 8/1992 | Morris . | |
| 5,153,802 | | 10/1992 | Mertz et al. . | |
| 5,155,315 | | 10/1992 | Malkin et al. . | |
| 5,166,483 | | 11/1992 | Kersusan et al. . | |
| 5,172,087 | | 12/1992 | Castonguay et al. . | |
| 5,178,504 | | 1/1993 | Falchi . | |
| 5,184,717 | | 2/1993 | Chou et al. . | |
| 5,187,339 | | 2/1993 | Lissandrin . | |
| 5,198,956 | | 3/1993 | Dvorak . | |
| 5,200,724 | | 4/1993 | Gula et al. . | |
| 5,210,385 | | 5/1993 | Morel et al. . | |
| 5,239,150 | | 8/1993 | Bolongeat-Mobleu et al. . | |
| 5,260,533 | | 11/1993 | Livesey et al. . | |
| 5,262,744 | | 11/1993 | Arnold et al. . | |
| 5,280,144 | | 1/1994 | Bolongeat-Mobleu et al. . | |
| 5,281,776 | | 1/1994 | Morel et al. . | |
| 5,296,660 | | 3/1994 | Morel et al. . | |
| 5,296,664 | | 3/1994 | Crookston et al. . | |
| 5,298,874 | | 3/1994 | Morel et al. . | |
| 5,300,907 | | 4/1994 | Nereau et al. . | |
| 5,310,971 | | 5/1994 | Vial et al. . | |
| 5,313,180 | * | 5/1994 | Vial et al. | 218/22 |
| 5,317,471 | | 5/1994 | Izoard et al. . | |
| 5,331,500 | | 7/1994 | Corcoles et al. . | |
| 5,334,808 | | 8/1994 | Bur et al. . | |
| 5,341,191 | | 8/1994 | Crookston et al. . | |
| 5,347,096 | | 9/1994 | Bolongeat-Mobleu et al. . | |
| 5,347,097 | | 9/1994 | Bolongeat-Mobleu et al. . | |
| 5,350,892 | | 9/1994 | Rozier . | |
| 5,357,066 | | 10/1994 | Morel et al. . | |
| 5,357,068 | | 10/1994 | Rozier . | |
| 5,357,394 | | 10/1994 | Piney . | |
| 5,361,052 | | 11/1994 | Ferullo et al. . | |
| 5,373,130 | | 12/1994 | Barrault et al. . | |
| 5,379,013 | | 1/1995 | Coudert . | |
| 5,424,701 | | 6/1995 | Castonguary et al. . | |
| 5,438,176 | | 8/1995 | Bonnardel et al. . | |
| 5,440,088 | | 8/1995 | Coudert et al. . | |
| 5,449,871 | | 9/1995 | Batteux et al. . | |
| 5,450,048 | | 9/1995 | Leger et al. . | |
| 5,451,729 | | 9/1995 | Onderka et al. . | |
| 5,457,295 | | 10/1995 | Tanibe et al. . | |
| 5,467,069 | | 11/1995 | Payet-Burin et al. . | |
| 5,469,121 | | 11/1995 | Payet-Burin . | |
| 5,475,558 | | 12/1995 | Barjonnet et al. . | |
| 5,477,016 | | 12/1995 | Baginski et al. . | |
| 5,479,143 | | 12/1995 | Payet-Burin . | |
| 5,483,212 | | 1/1996 | Lankuttis et al. . | |
| 5,485,343 | | 1/1996 | Santos et al. . | |
| 5,493,083 | | 2/1996 | Olivier . | |
| 5,504,284 | | 4/1996 | Lazareth et al. . | |
| 5,504,290 | | 4/1996 | Baginski et al. . | |
| 5,510,761 | | 4/1996 | Boder et al. . | |
| 5,512,720 | | 4/1996 | Coudert et al. . | |
| 5,515,018 | | 5/1996 | DiMarco et al. . | |
| 5,519,561 | | 5/1996 | Mrenna et al. . | |
| 5,534,674 | | 7/1996 | Steffens . | |
| 5,534,832 | | 7/1996 | Duchemin et al. . | |

| | | | |
|---|---|---|---|
| 5,534,835 | | 7/1996 | McColloch et al. . |
| 5,534,840 | | 7/1996 | Cuingnet . |
| 5,539,168 | | 7/1996 | Linzenich . |
| 5,543,595 | | 8/1996 | Mader et al. . |
| 5,552,755 | | 9/1996 | Fello et al. . |
| 5,581,219 | | 12/1996 | Nozawa et al. . |
| 5,604,656 | | 2/1997 | Derrick et al. . |
| 5,608,367 | | 3/1997 | Zoller et al. . |
| 5,694,098 | * | 12/1997 | Mody et al. ..... 335/16 |
| 5,784,233 | | 7/1998 | Bastard et al. . |

FOREIGN PATENT DOCUMENTS

| | | |
|---|---|---|
| 0 295 158 | 12/1988 | (EP) . |
| 0 309 923 | 4/1989 | (EP) . |
| 0 313 106 | 4/1989 | (EP) . |
| 0 313 422 | 4/1989 | (EP) . |
| 0 314 540 | 5/1989 | (EP) . |
| 0 331 586 | 9/1989 | (EP) . |
| 0 337 900 | 10/1989 | (EP) . |
| 0 342 133 | 11/1989 | (EP) . |
| 0 367 690 | 5/1990 | (EP) . |
| 0 371 887 | 6/1990 | (EP) . |
| 0 375 568 | 6/1990 | (EP) . |
| 0 394 144 | 10/1990 | (EP) . |
| 0 394 922 | 10/1990 | (EP) . |
| 0 399 282 | 11/1990 | (EP) . |
| 0 407 310 | 1/1991 | (EP) . |
| 0 452 230 | 10/1991 | (EP) . |
| 0 555 158 | 8/1993 | (EP) . |
| 0 560 697 | 9/1993 | (EP) . |
| 0 567 416 | 10/1993 | (EP) . |
| 0 595 730 | 5/1994 | (EP) . |
| 0 619 591 | 10/1994 | (EP) . |
| 0 665 569 | 8/1995 | (EP) . |
| 0 700 140 | 3/1996 | (EP) . |
| 0 889 498 | 1/1999 | (EP) . |
| 2 410 353 | 6/1979 | (FR) . |
| 2 512 582 | 3/1983 | (FR) . |
| 2 553 943 | 4/1985 | (FR) . |
| 2 592 998 | 7/1987 | (FR) . |
| 2 682 531 | 4/1993 | (FR) . |
| 2 697 670 | 5/1994 | (FR) . |
| 2 699 324 | 6/1994 | (FR) . |
| 2 714 771 | 7/1995 | (FR) . |
| 2 233 155 | 1/1991 | (GB) . |
| 92/00598 | 1/1992 | (WO) . |
| 92/05649 | 4/1992 | (WO) . |
| 94/00901 | 1/1994 | (WO) . |

* cited by examiner

MAGNETIC SHUNT ASSEMBLY

FIELD OF THE INVENTION

This invention relates to circuit breakers and, more particularly, a means for enhancing a magnetic field of the "reverse loop", a portion of the circuit breaker wherein a line or load strap it is partially looped around itself to provide a repelling electromagnetic force which will ultimately cause the circuit breaker to trip if the force exceeds the tolerances of the breaker.

BACKGROUND OF THE INVENTION

The configuration of a "reverse loop" generates a magnetic field that applies a force in an opposite direction of a movable contact mechanism of a circuit breaker. Under "short circuit" or "tripping" conditions, large currents pass through the reverse loop, and accordingly, the magnetic field which applies a force on the movable contact mechanism causes the circuit breaker to trip by applying a force which is greater than the force of the movable contact mechanism.

Generally, and in order to enhance the electromagnetic force of the reverse loop, a magnetic flux concentrator, usually in the form of a steel block, is positioned within the partially looped portion of the conductive path of a reverse loop.

The steel block shunts another magnetic field and accordingly its force that is opposite to the magnetic field that applies a force in a direction opposite to a force that maintains the movable contact mechanism in a closed or current carrying configuration. Therefore, the placement of a magnetic flux concentrator within the reverse loop enhances the magnetic field that causes the circuit breaker to trip in overload situations.

Since a magnetic field can only penetrate a limited distance into the steel block, the "skin effect" of the steel block limits the effectiveness of the shunt.

The placement of the magnetic flux concentrator requires the implementation of at least one insulating buffer zone positioned between the magnetic flux concentrator and a portion of the reverse loop. This buffer zone prevents the short circuit of the reverse loop.

U.S. Pat. No. 5,313,180 entitled Molded Case Circuit Breaker Contact, describes a rotary circuit breaker. This patent describes the use of an anvil formed from a rigid metal block. The anvil is positioned in between the two strands of a current input conductor or "reverse loop" and makes contact with one of the strands to receive impact forces from the movable contact as it strikes the stationary contact positioned on the strand making contact with the anvil.

SUMMARY OF THE INVENTION

In an exemplary embodiment of the present invention, an enhanced magnetic field is provided through the use of a magnetic flux concentrator having a plurality of layers.

In another exemplary embodiment of the present invention, and to position each successive layer onto the next, each layer is configured to have at least one protrusion on one surface and a least one recess on the other surface. The recesses are configured to receive the protrusions.

DESCRIPTION OF THE PREFERRED EMBODIMENTS

Figure 1:
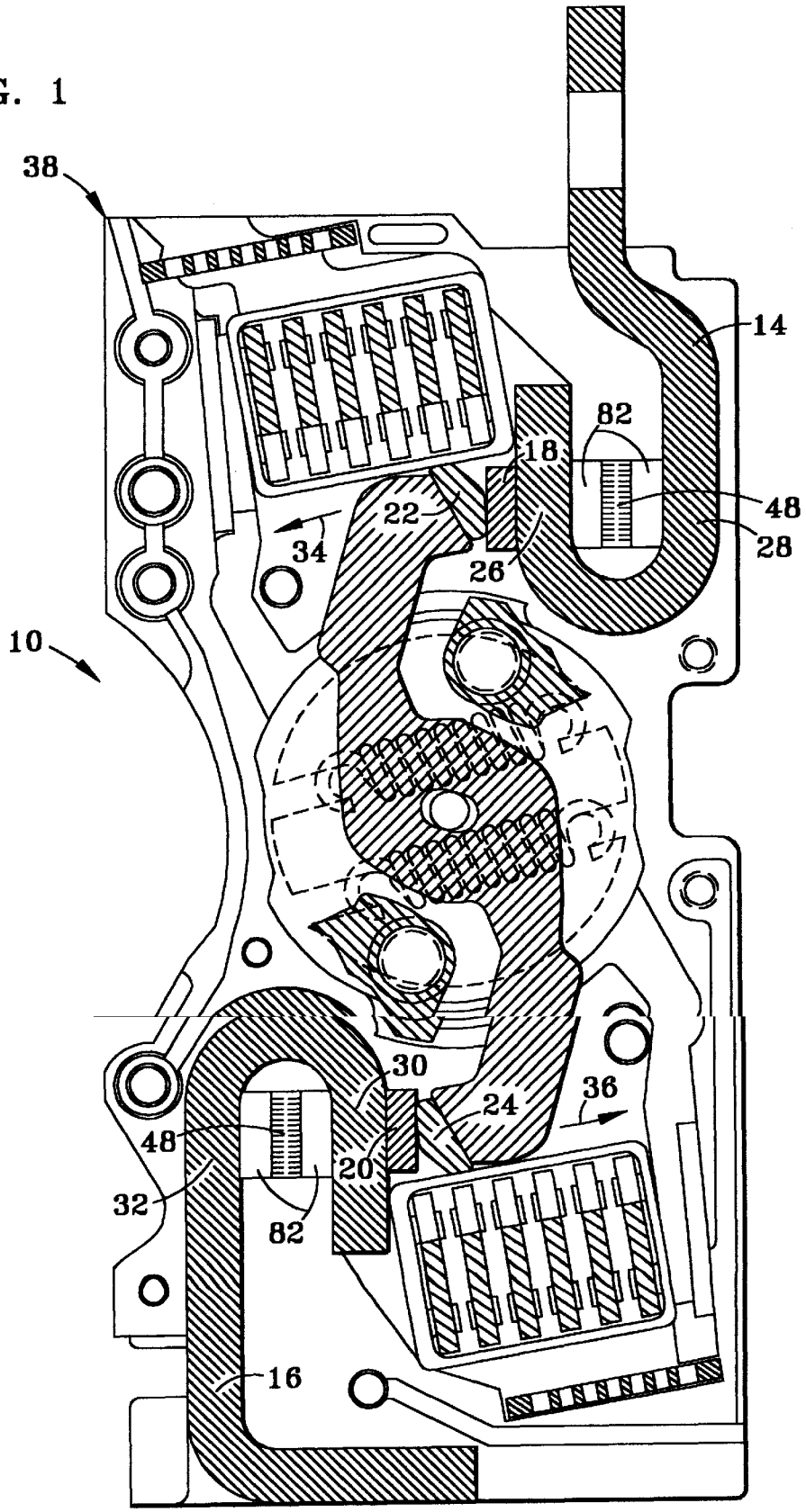
FIG. 1 is a front plan view of a circuit breaker assembly of the type employing a rotary contact operating mechanism having the magnetic flux concentrator of the present invention.

FIG. 1, generally illustrates a circuit interruption mechanism 10 having a movable contact assembly 12.

A line strap 14 and a load strap 16, a pair of stationary contacts 18 and 20, a pair of movable contacts 22 and 24 and movable contact assembly 12 generally complete the circuit from an electrical supply line to a given load.

Figure 2:
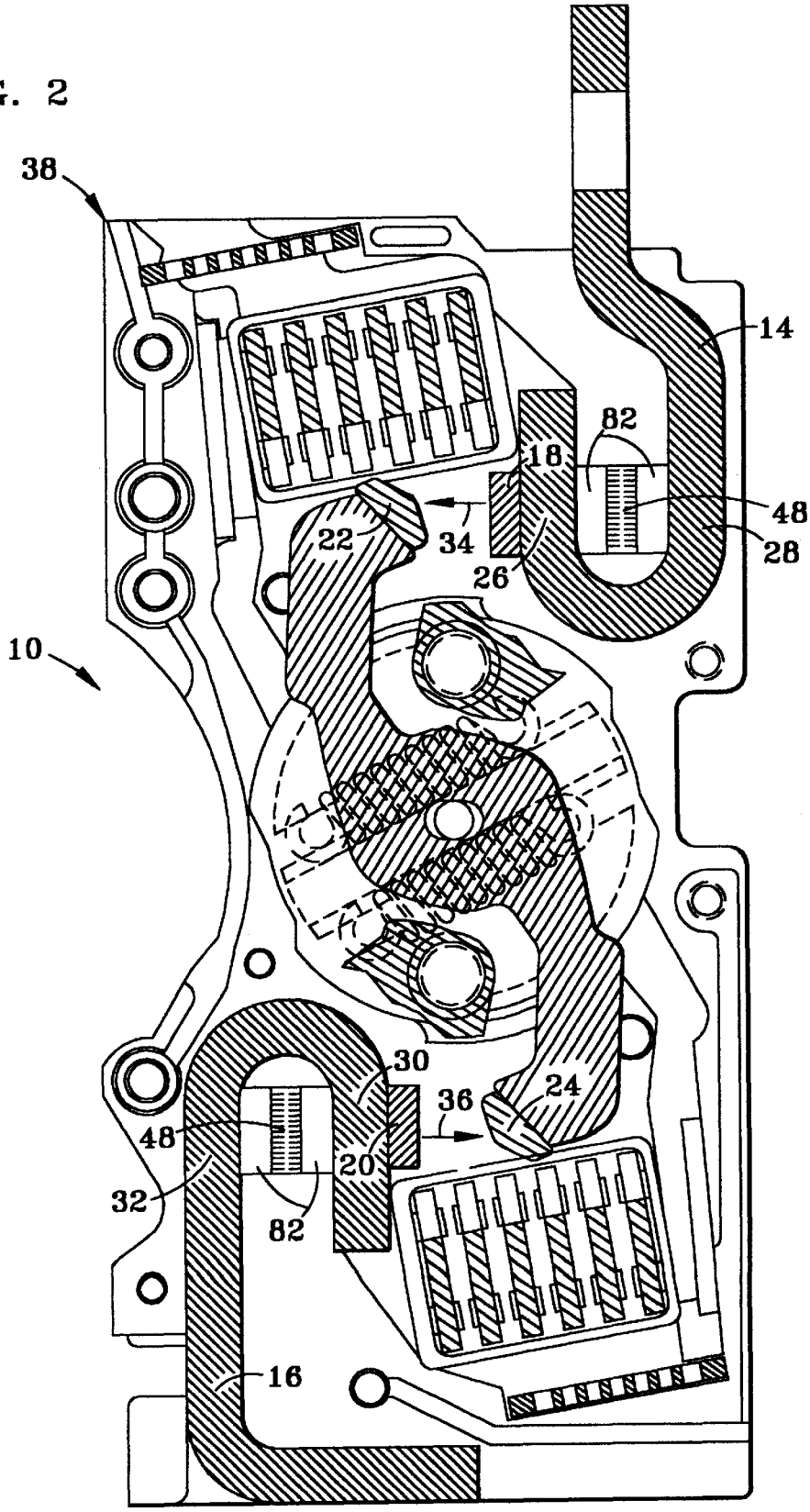
FIG. 2 is a front plan view illustrating a possible position of the circuit breaker assembly illustrated in FIG. 1.

FIG. 1 illustrates circuit breaker 10 in a closed or reset position while FIG. 2 illustrates circuit breaker 10 in an open or tripped position.

Line strap 14 and load strap 16 are configured to have a partial or uncompleted loop at their ends. This results in straps 14 and 16 being folded or doubled upon themselves causing a first portion 26 to be in a facing spaced relationship with respect to a second portion 28 of line strap 14.

Similarly, and as contemplated with a circuit breaker have both a line and load strap configuration a first portion 30 is also in a facing spaced relationship with respect to a second portion 32 of load strap 16.

Straps 14 and 16 provide a conductive path and are adapted for connection with an associated electrical distribution system and a protected electric circuit. Alternatively, and as desired, straps 14 and 16 can be either a line or a load strap.

Stationary contacts 18 and 20 are connected to receive an electrical current from straps 14 and 16. Accordingly, and as illustrated in FIG. 2, when movable contact assembly 12 is in its closed or reset position, movable contacts 22 and 24 make contact with stationary contacts 18 and 20 thereby completing the circuit from line strap 14 to load strap 16.

As an electrical current flows through straps 14 and 16 it is noted that the portion of straps 14 and 16, in close proximity to stationary contacts 18 and 20, will have currents of opposite polarities with respect to the electrical current flowing through movable contact assembly 12.

This configuration generates a magnetic field having a force in the direction of arrows 34 and 36. Movable contact assembly 12 is maintained in its closed position by a mechanical force in the opposite direction of arrows 34 and 36. Once the force in the direction of arrows 34 and 36 overcomes the mechanical force maintaining movable contact assembly 12 in its closed position, the circuit breaker trips and movable contacts 22 and 24 no longer make contact with stationary contacts 18 and 20.

Figure 3:
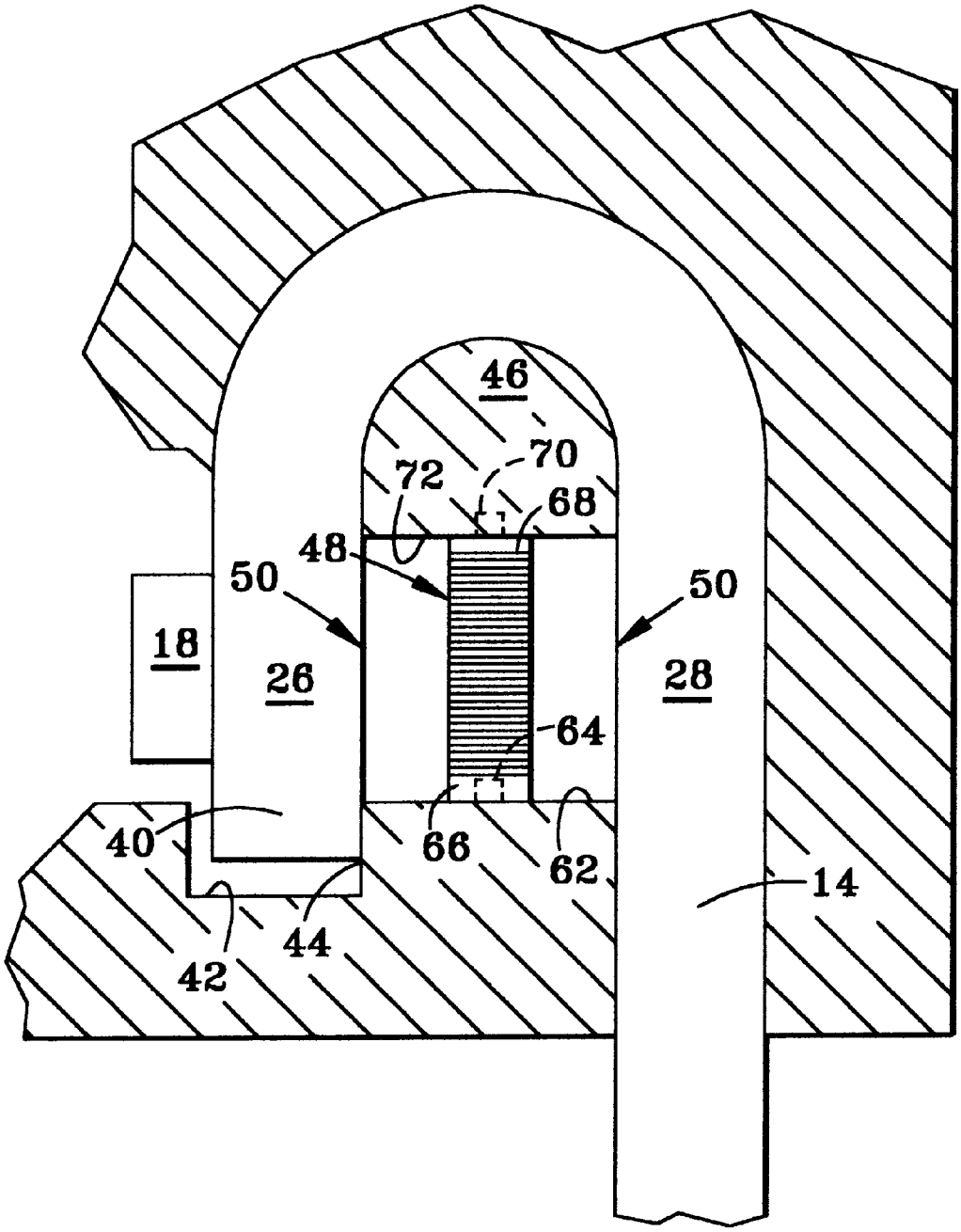
FIG. 3 is a front plane view of illustrating the magnetic flux concentrator and component parts of a circuit interruption mechanism.
Figure 4:
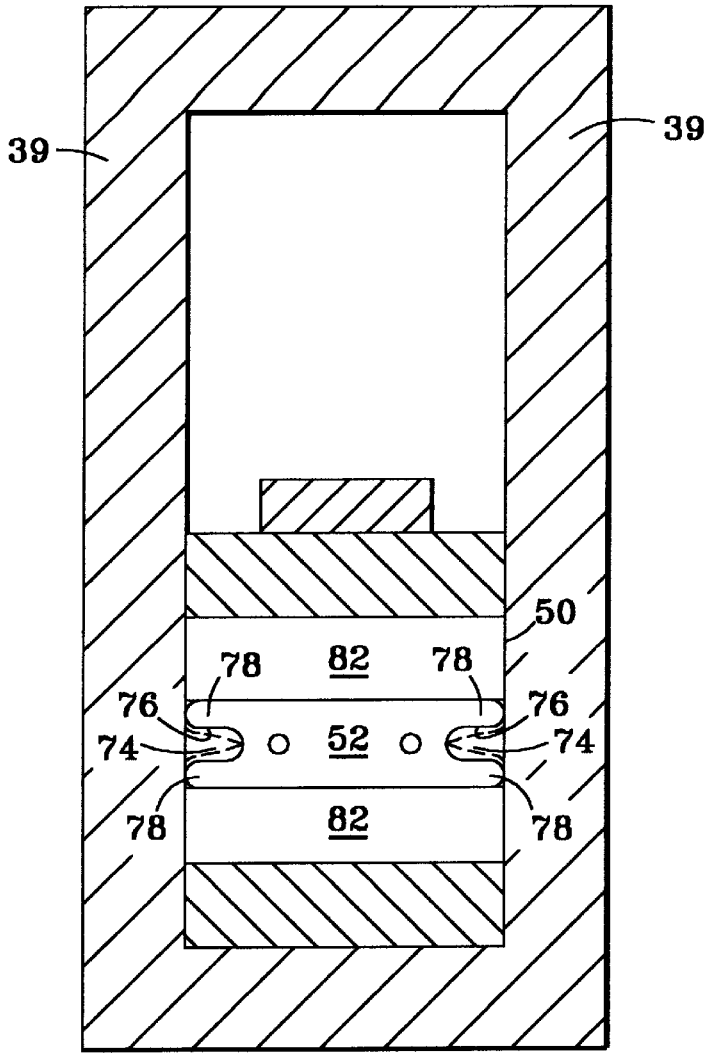
FIG. 4 is a view along lines 4—4 of the FIG. 3 embodiment.
Figure 5:
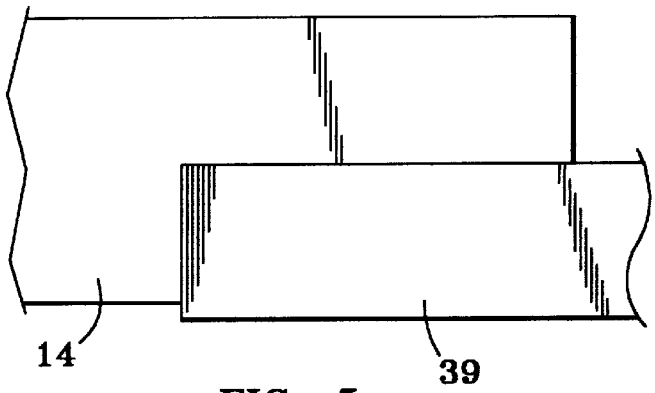
FIG. 5 is a view along lines 5—5 of the FIG. 3 embodiment.

Referring now to FIGS. 3 and 4, and in accordance with the present invention, strap 14 is received within a cassette body portion 38 of circuit breaker 10. Body portion 38 is constructed out of a pair of body portions 39. Cassette body portions 39 are constructed out a molded plastic having insulating properties, as well as being durable and lightweight.

Body portions 39 are secured to each other through a securement means such as, but not limited to the following; rivets, screws, nut and bolt arrangement, adhesives or any other method of securement.

As illustrated in FIG. 3, line strap 14 partially loops back over itself and terminates in an end 40.

Each cassette body portion 39 is configured to have a receiving area 42 configured to receive and support the end portion 40 of line strap 14.

Similarly, each cassette body portion 39 has a shoulder 44 that provides support to end 40. Additional support is provided to line strap 14 through a support surface 46 positioned on each cassette body portion. Support surfaces 46 are configured to support a portion of line strap 14. The positioning of shoulders 44 and support surfaces 46 provide support to portion 26, and accordingly, stationary contact 18 of line strap 14.

Alternatively, strap 14 is supported in close proximity to stationary contact 18.

This additional support of line strap 14 prevents portion 26 of line strap 14 and accordingly stationery contact 18 from being deformed through repeated operation of the circuit breaker. For example, as circuit breaker 10 is opened and closed, tripped and reset, the movable contacts 22 and 24 repeatedly hammer into stationary contacts 18 and 20. In addition, and during normal operational parameters, a substantial mechanical force is applied to movable contact assembly 12 in order to maintain the connection between movable contacts 22 and 24 and stationary contacts 18 and 20. Therefore, portions 26 and 30, as well as stationary contacts 18 and 20 require support.

Also, the repeated loading force of movable contacts 22 and 24 into stationary contacts 18 and 20 may cause an additional force to be acted upon the surrounding portions 26 and 30 of line strap 14 and load strap 16 respectively.

Moreover, as the circuit breaker is repeatedly tripped, the line and load straps (14, 16) as well as their complementary stationery contacts (18, 20) may be heated and subsequently cooled. This heating and cooling may cause the copper and/or other conductive materials used for the straps and contacts to become annealed.

In addition, stationary contacts 18 and 20 are usually brazed to the respective portion of line strap 14 and load strap 16. This process also may attribute to the annealing of the copper in line strap 14, load strap 16 and stationary contacts 18 and 20.

Referring now in particular to FIGS. 3–8, a magnetic flux concentrator 48 is positioned within an opening 50 of cassette body portions 38*a* and 38*b*. The position of magnetic flux concentrator 48 in opening 50 enhances the magnetic field of the current flowing through portion 26, stationary contact 18, movable contact 22 and the area of movable contact assembly 12 in close proximity to movable contact 22. Accordingly, the enhancement of this magnetic field also enhances the force in the direction of arrow 34.

Magnetic flux concentrator 48 is constructed out of a plurality of steel plates 52 which are stacked upon each other. Since the magnetic field of portion 28 can only penetrate a limited distance into steel, (the skin effect) the utilization of a plurality of steel plates 52 enhances the effectiveness of magnetic flux concentrator 48.

By replacing a solid steel block with a plurality of steel plates 52 the magnetic field generated by the current flowing through portion 28 can now penetrate deeper into the steel of magnetic flux concentrator 48 as it penetrates to the same depth, however, it is now penetrating into each plate 52.

Accordingly, the force in the direction of arrow 34 is enhanced as the magnetic field and opposite force generated by the current flowing through portion 28 is shunted by magnetic flux concentrator 48.

Figure 6:
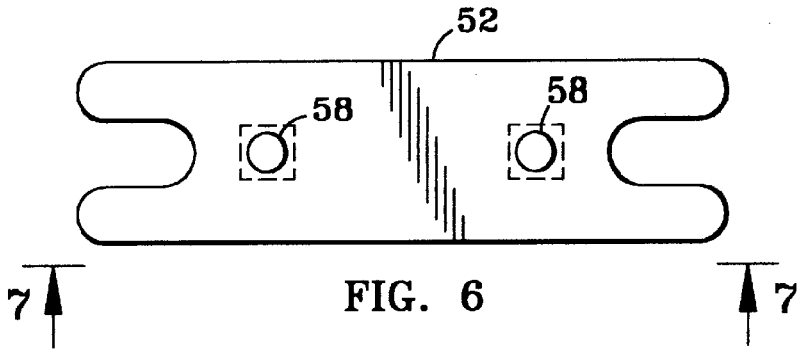
FIG. 6 is a top plan view of the present invention.
Figure 7:
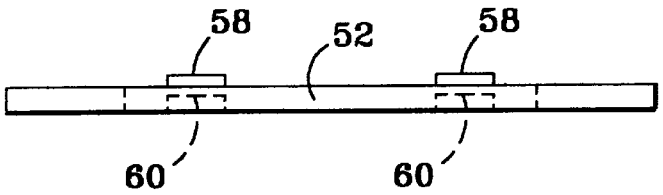
FIG. 7 is a view along lines 7—7 of the FIG. 6 embodiment.
Figure 8:
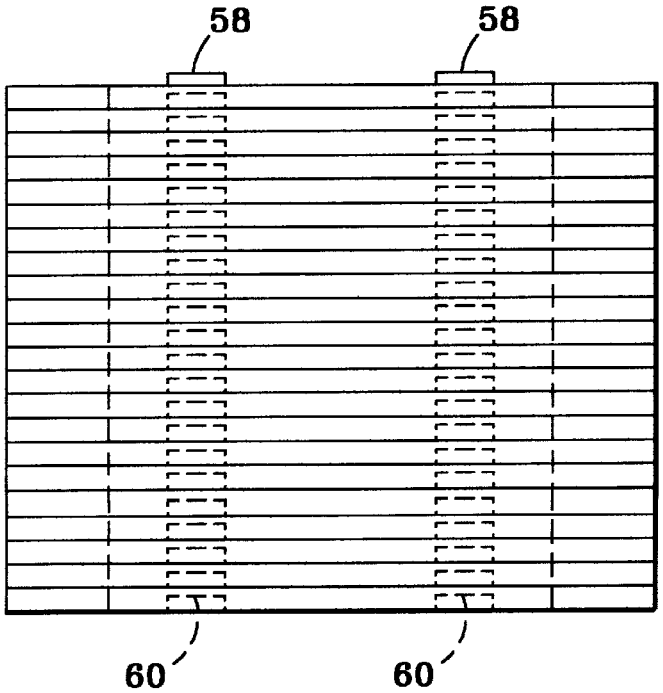
FIG. 8 is a side plan view of the present invention.

Referring now in particular to FIGS. 6–8, each steel plate 52 each has an upper surface 54 and a lower surface 56. Each steel plate 52 is configured to have a pair of pimples or protrusions 58 which extend outwardly from upper surface 54 of steel plate 52.

In addition, each steel plate 52 is configured to have a pair of indentations or recesses 60 in lower surface 56 of plate 52. Accordingly, and as steel plates 52 are stacked upon each other, protrusions 58 are positioned to be received within indentations 60 of each successive plate 52. Cassette body portion 39 has an inner surface 62 that is configured to have a pair of protrusions or pimples 64 which extend into opening 50. Pimples 64 are of a similar size and configuration of pimples 58 and are received into indentations 60 of a first steel plate 66.

Steel plates 52 are then successively stacked upon each other until pimples 58 of a last steel plate 68 are received into a pair of indentations or depressions 70 positioned on an inner surface 72 of cassette body portion 39.

Referring now in particular to FIG. 4, each cassette body portion 39 has a tab portion or sidewall 74 that extends into opening 50. In addition, each steel plate 52 is configured to have a pair of receiving areas 76 positioned at either end of steel plate 52. Receiving area 76 is positioned intermediate a pair of tabs 78 which are positioned on each end of steel plate 52. Tab portion 74 is configured to be received and engaged within receiving areas 76 of steel plate 52. In addition, tab portions 78 of steel plate 52 are positioned at either end of tab 74 once tab 74 is received within receiving area 76.

Tabs 74 are positioned in a facially spaced relationship so as to define an additional means for retaining magnetic flux concentrator 48 in a fixed position. Moreover, tabs 74 are also constructed out of a molded plastic that gives them insulating properties.

Accordingly, tab portions 74, pimples 64 and indentations 70 maintain magnetic flux concentrator 48 in a fixed position within opening 50. Magnetic flux concentrator 48 is now positioned in between portions 26 and 28 of strap 14. Moreover the positioning of magnetic flux concentrator 48 provides for a pair of air which air gaps 82 insulate magnetic flux concentrator 48 from portions 26 and 28 of line strap 14. This prevents, magnetic flux concentrator 48 from shorting out the "reverse loop" under high current or load conditions.

Moreover, and in high current conditions, there is a possibility of a "flashover", a condition in which the current bridges the air gap between magnetic flux concentrator 48 and a portion of line strap 14. In this embodiment, the positioning and inclusion of two air gaps 82 will make it harder for magnetic flux concentrator 48 to short-circuit the "reverse loop" via a "flashover" condition as both air gaps 82 will have to be bridged.

As an alternative, and as illustrated by the dashed lines in FIG. 4, and in order to facilitate the insertion of magnetic flux concentrator 48 into opening 50 of cassette body portion 38, tabs 74 are chamfered to give tabs 74 a significantly smaller surface area than receiving area 76.

As an alternative, air gap 82 is completely or partially replaced with a polymeric or other material that has insulating properties.

It is, of course, understood and contemplated that the present invention can be used with a circuit breaker having both a line and load strap or a single contact circuit breaker.

Figure 9:
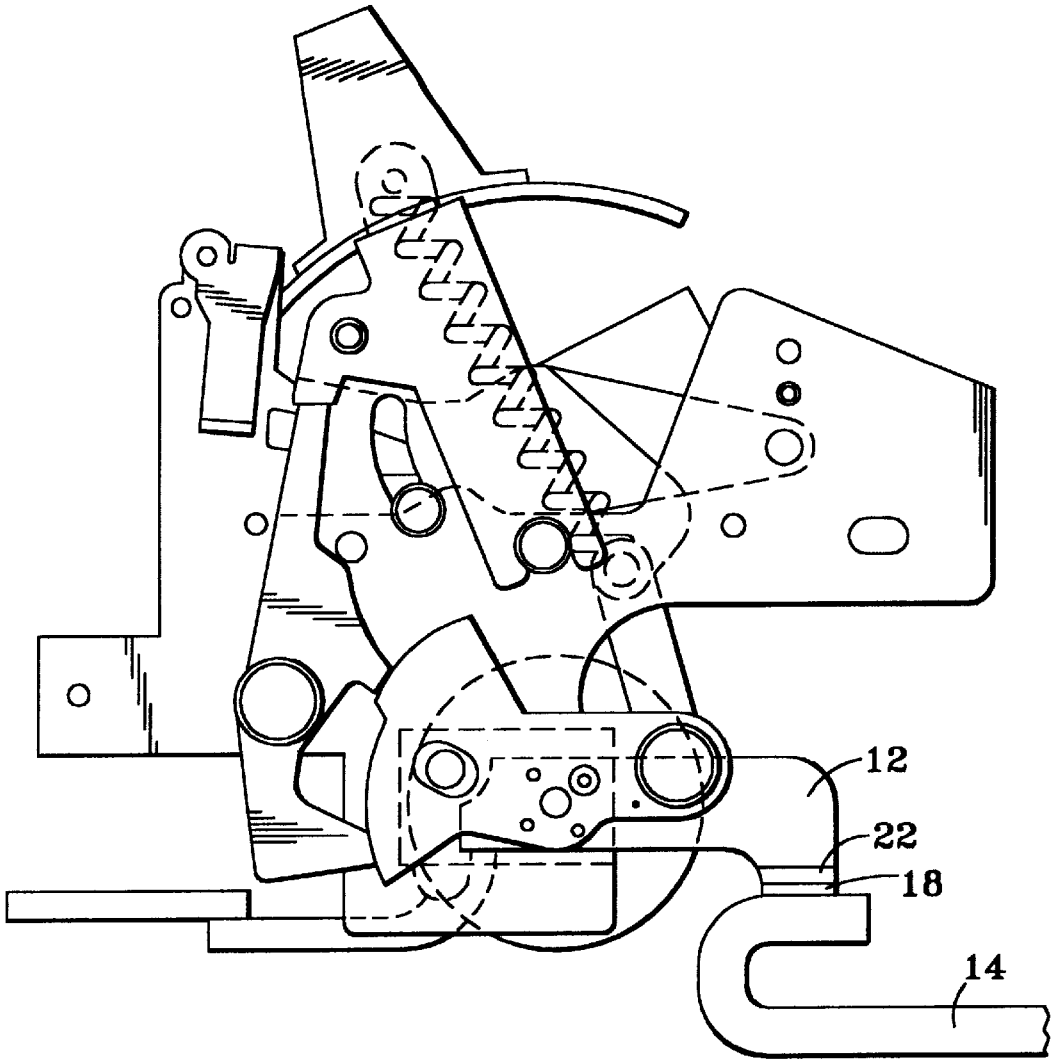
FIG. 9 is a side plan view of a circuit interruption mechanism having a single movable contact.
Figure 10:
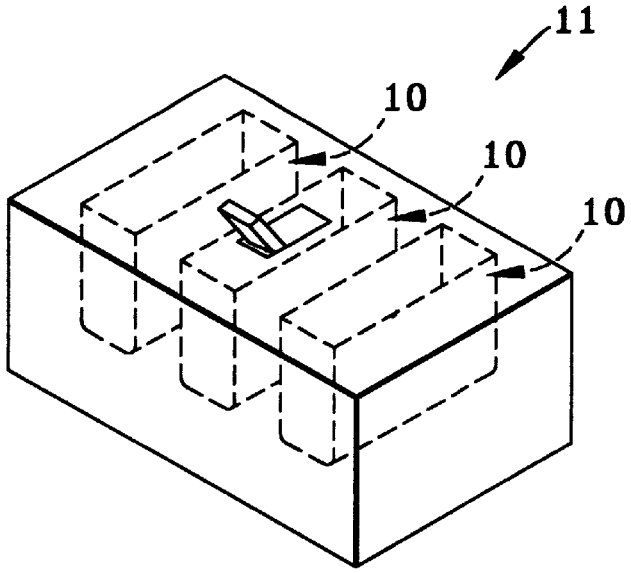
FIG. 10 is a perspective view illustrating a circuit breaker.

In addition, one such contemplated use of the present invention is with a circuit breaker having a single reverse loop. One such circuit breaker is illustrated in FIG. 9.

In the preferred embodiment, opening 50 is approximately 24.1 mm in the direction in which plates 52 are stacked. As also contemplated in the preferred embodiment, each plate 52 has the following dimensions 24 mm×7 mm×0.6 mm. Accordingly, and in the preferred embodiment 40 plates 52 are required to fill opening 50.

As an alternative, the thickness of plates 52 may very in a range of 5 mm to 0.1 mm. Accordingly, and as the dimension of plate 52, opening 50 or both varies, the number of plates 52 required also varies.

As contemplated in accordance with the present invention, magnetic flux concentrator 48 is constructed out of a plurality of steel plates 52 which are stamped out a. In addition, and at the same time of the stamping of steel plates 52, the plates are stamped or punched on the lower surface of the first plate in order to cause indentations 60 and accordingly dimples 58 to be positioned on each steel plate 52.

This process ensures that protrusions 58 and recesses 60 are uniform and protrusions 58 are completely received into recesses 60 of each successive steel plate 52. Moreover, it is also this configuration that allows each successive plate to be positioned directly over the preceding plate 52.

In addition, there is no overlapping of plates 52 at their periphery as well as the sidewalls of magnetic flux concentrator 48.

Since plates 52, protrusions 58 and their matching recesses 60 are stamped simultaneously, this process also allows for a magnetic flux concentrator 48 to be constructed in a single manufacturing step.

As an alternative, plates 52 are stamped to have protrusions 58 and accordingly indentations 60 of an alternative configuration such as the squarish configuration illustrated by the dashed lines in FIG. 6. Of course it is contemplated that other configurations may be used including, but not limited to the following; triangles, polygons, circles, hexagons, stars and other configurations resulting in a protrusion from one surface of one plate 52 into a corresponding or matching indentation of another surface of another plate 52.

Each plate 52 is constructed out of a ferromagnetic material such as cold rolled steel. However, and as an alternative, plates 52 may be stamped out the other ferromagnetic materials such as iron, cobalt and nickel.

Figure 11:
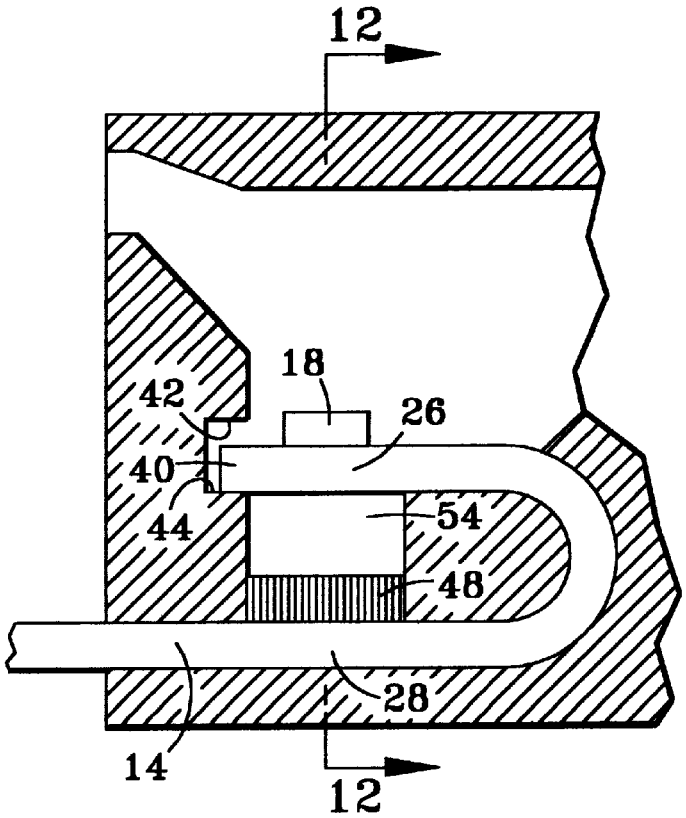
FIG. 11 is a side plan view of an alternative embodiment of the present invention.
Figure 12:
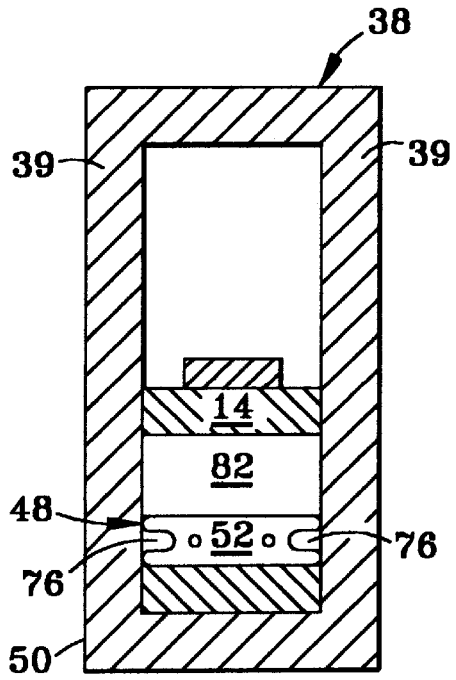
FIG. 12 is a view along lines 12—12 of the FIG. 11 embodiment.

As an alternative, the positioning of tab portions or sidewalls 76 which extend inwardly towards each other from cassette body portions 39 is varied. See FIGS. 11 and 12 In this embodiment, the positioning of magnetic flux concentrator 48 allows portion 28 of strap 14 to make contact with magnetic flux concentrator 48 while portion 26 is insulated from magnetic flux concentrator 48 by a single air gap 82. This configuration will also prevent magnetic flux concentrator 48 from short-circuiting the reverse loop.

Figure 13:
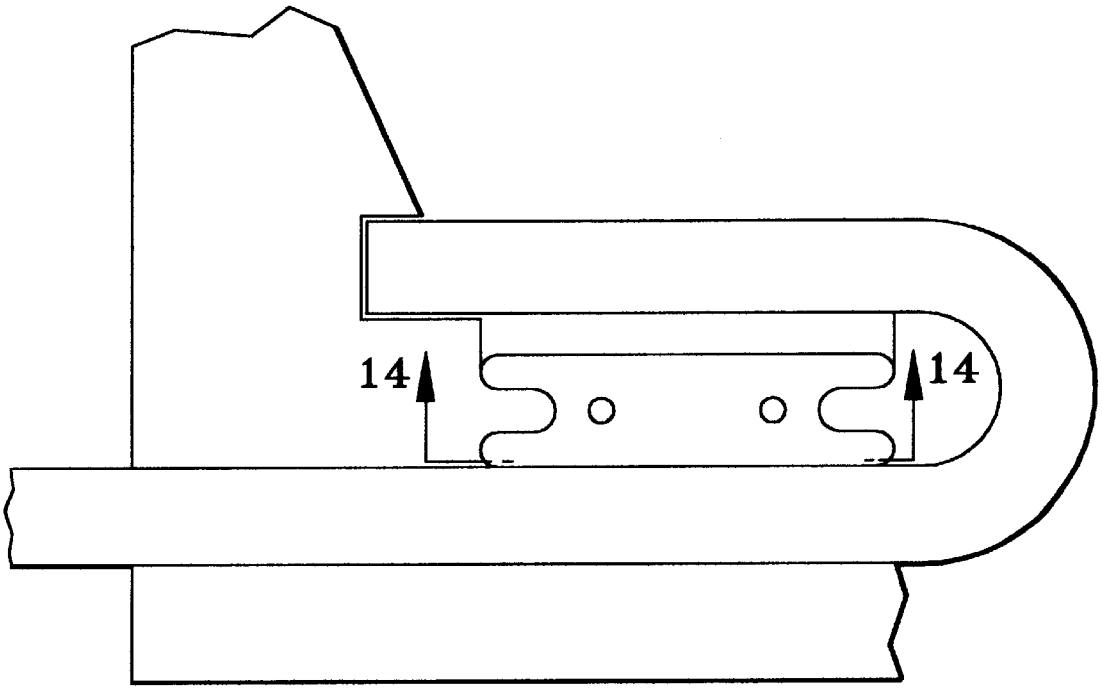
FIG. 13 is a side plane view of an alternative embodiment of the present invention.
Figure 14:
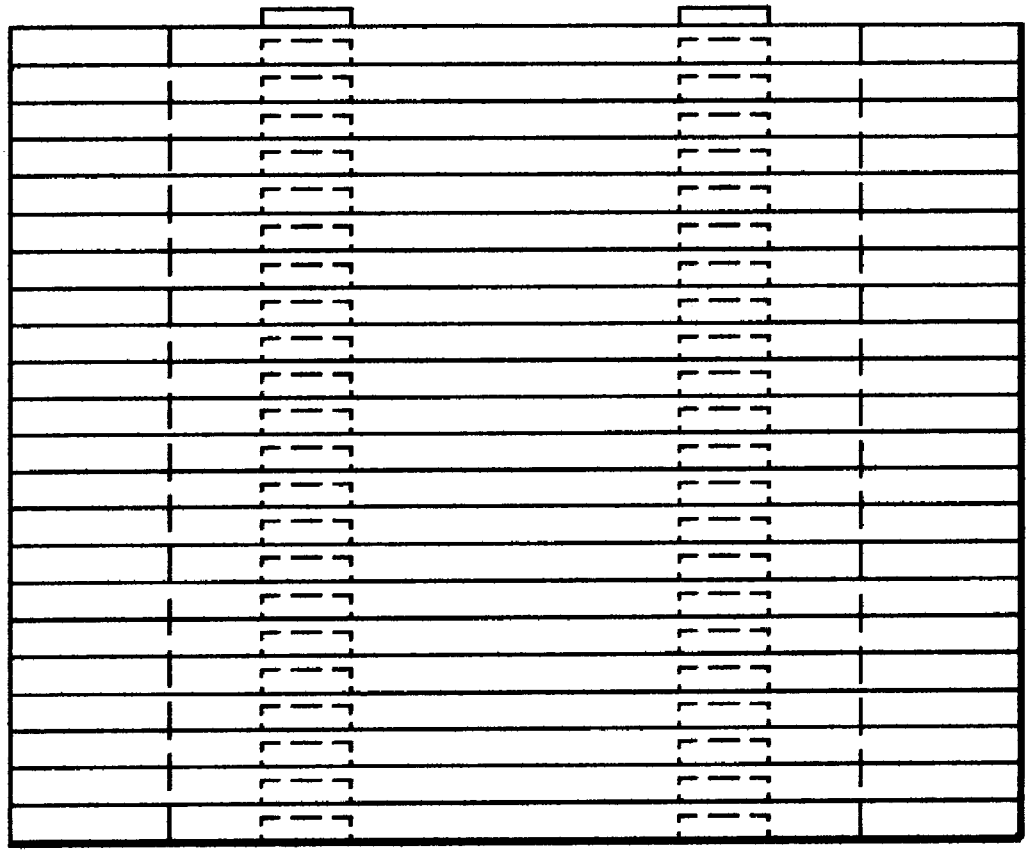
FIG. 14 is a view along lines 14—14 of the FIG. 13 embodiment.

In yet another alternative embodiment, and as illustrated by FIGS. 13 and 14 the positioning of tabs 76 is varied once again. In this embodiment magnetic flux concentrator 48 is rotated 90 degrees from the position illustrated in FIGS. 11 and 12.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. The method of shunting a magnetic field of a circuit interruption mechanism, said method comprising:

a) inserting a ferromagnetic structure within an area defined by a conductive strap, said ferromagnetic structure comprising a plurality of layers each one of said layers having at least one protrusion on an upper surface and at least one receiving area on a lower surface; and b) supporting said ferromagnetic structure by engaging a pair of receiving areas, said receiving areas being configured, dimensioned and positioned along the periphery of said ferromagnetic layers, said ferromagnetic structure being supported in a spatial relationship with respect to a portion of said conductive strap.

2. A circuit breaker comprising:

a) at least one circuit interruption mechanism having at least one cassette, said cassette having inner and outer walls, said inner walls receiving and supporting a first conductive path, a portion of said first path being partially looped upon itself and having a first portion and a second portion, said first and second portions defining a first area;

b) a pair of supporting members depending outwardly from said inner walls and being configured and dimensioned to be positioned in between said first and second portions of said first conductive path, said pair of supporting members supporting said first portion and further define said area;

c) a pair of tabs, one of said tabs extending outwardly from one of said pair of side walls into said area and the other one of said tabs extends outwardly from the other side wall into said area;

d) a ferromagnetic material being positioned within said area and being supported by said pair of tabs whereby said ferromagnetic material is in a spaced relationship with respect to said first portion of said conductive path, said ferromagnetic material having:

i) a first ferromagnetic layer having a lower surface and an upper surface;

ii) a second ferromagnetic layer having a lower surface and an upper surface;

iii) at least one ferromagnetic layer being positioned within said first and second ferromagnetic layers and having a lower surface and an upper surface;

iv) at least one recess in said lower surfaces of said ferromagnetic layers;

v) at least one protrusion in said upper surfaces of said ferromagnetic layers, said protrusion being configured, dimensioned and positioned to be received into said recess; and vi) a pair of receiving areas positioned along the periphery of said ferromagnetic layers, said pair of receiving areas defining a pair of channels on said ferromagnetic material, said pair of channels being configured, dimensioned and positioned to receive and engage said pair of tabs.

3. A circuit breaker, comprising:

a) at least one circuit interruption mechanism having at least one cassette, said cassette having inner and outer walls, said inner walls receiving and supporting a first conductive path, a portion of said first path being partially looped upon itself and having a first portion and a second portion, said first and second portions defining a first area;

b) a pair of supporting members depending outwardly from said inner walls and being configured and dimensioned to be positioned in between said first and second portions of said first conductive path, said pair of supporting members supporting said first portion and further define said area;

c) a pair of tabs, one of said tabs extending outwardly from one of said pair of side walls into said area and the other one of said tabs extends outwardly from the other side wall into said area;

d) a ferromagnetic material being positioned within said area and being supported by said pair of tabs whereby said ferromagnetic material is in a spaced relationship with respect to said first portion of said conductive path, wherein said ferromagnetic material is a magnetic flux concentrator.

4. A ferromagnetic structure for use in a circuit interruption mechanism, comprising:

a) a first ferromagnetic layer having a lower surface and an upper surface;

b) a second ferromagnetic layer having a lower surface and an upper surface;

c) at least one ferromagnetic layer being positioned within said first and second ferromagnetic layers and having a lower surface and an upper surface;

d) at least one recess in said lower surfaces of said ferromagnetic layers;

e) at least one protrusion in said upper surfaces of said ferromagnetic layers, said protrusion being configured, dimensioned and positioned to be received into said recess; and said ferromagnetic structure being positioned within an area defined by a conductive path of said circuit interruption mechanism, wherein said ferromagnetic layers each have a pair of receiving areas positioned along the periphery of said ferromagnetic layers, said pair of receiving areas defining a pair of channels on said ferromagnetic material, said pair of channels being configured, dimensioned and positioned to receive and engage a pair of tabs depending into said area defined by said conductive path.

5. The ferromagnetic structure as in claim 4, further including:

f) a housing for said circuit interruption mechanism, said housing defining an area for receiving said ferromagnetic structure, said area comprising:

i) a pair of retaining members depending into said area from said housing, said pair of retaining members being configured, dimensioned and positioned to engage said pair of channels; and g) a first air gap positioned in between said ferromagnetic structure and a portion of a conductive path surrounding a portion of said area.

6. A ferromagnetic structure for use in a circuit interruption mechanism, said ferromagnetic structure comprising:

a) a first ferromagnetic layer having a lower surface and an upper surface;

b) a second ferromagnetic layer having a lower surface and an upper surface;

c) at least one ferromagnetic layer being positioned within said first and second ferromagnetic layers and having a lower surface and an upper surface;

d) at least one recess in said lower surfaces of said ferromagnetic layers;

e) at least one protrusion in said upper surfaces of said ferromagnetic layers, said protrusion being configured, dimensioned and positioned to be received into said recess; and said ferromagnetic structure being positioned within an area defined by a conductive path of said circuit interruption mechanism;

f) a housing for said circuit interruption mechanism, said housing defining an area for receiving said ferromagnetic structure, said area comprising:

i) a last recess being configured, dimensioned and positioned to receive said protrusion of said upper surface of said last ferromagnetic layer; and ii) a first protrusion being configured, dimensioned and positioned to be received within said recess on said lower surface of said first ferromagnetic layer, and g) a pair of supporting members being configured, dimensioned and positioned to provide support to a portion of said conductive path, said pair of supporting members further define said area.

7. The ferromagnetic structure as in claim 6, further including:

h) a pair of tabs depending into said area defined by said conductive path, said tabs being configured, dimensioned and positioned to retain said ferromagnetic structure in a spatial relationship with respect to a portion of said conductive path.

8. The ferromagnetic structure as in claim 7, wherein said ferromagnetic layers each have a pair of receiving areas positioned along the periphery of said ferromagnetic layers, said pair of receiving areas defining a pair of channels on said ferromagnetic material, said pair of channels being configured, dimensioned and positioned to receive and engage said pair of tabs.

* * * * *